US008508355B2

(12) United States Patent
Pineau et al.

(10) Patent No.: US 8,508,355 B2
(45) Date of Patent: Aug. 13, 2013

(54) METHODS AND SYSTEMS FOR REMOTE MANAGEMENT OF SECURITY SYSTEMS

(75) Inventors: Richard Pineau, North Andover, MA (US); Adam Pineau, Haverhill, MA (US)

(73) Assignee: Oncam Global, Inc., Lowell, MA (US)

( * ) Notice: Subject to any disclaimer, the term of this patent is extended or adjusted under 35 U.S.C. 154(b) by 370 days.

(21) Appl. No.: 12/789,581

(22) Filed: May 28, 2010

(65) Prior Publication Data

US 2011/0205050 A1 Aug. 25, 2011

Related U.S. Application Data

(60) Provisional application No. 61/307,207, filed on Feb. 23, 2010.

(51) Int. Cl.
*G08B 29/00* (2006.01)

(52) U.S. Cl.
USPC ..... 340/506; 340/517; 340/531; 340/540; 340/541

(58) Field of Classification Search
USPC ..... 340/506, 517, 531, 540, 541
See application file for complete search history.

(56) References Cited

U.S. PATENT DOCUMENTS

| | | | | |
|---|---|---|---|---|
| 6,542,075 | B2 | 4/2003 | Barker et al. | |
| 6,717,513 | B1 | 4/2004 | Shprecher et al. | |
| 6,917,288 | B2 | 7/2005 | Kimmel et al. | |
| 6,965,313 | B1 * | 11/2005 | Saylor et al. | 340/539.18 |
| 6,972,676 | B1 | 12/2005 | Kimmel et al. | |
| 7,373,346 | B2 | 5/2008 | Hays et al. | |
| 2004/0086088 | A1 * | 5/2004 | Naidoo et al. | 379/37 |

FOREIGN PATENT DOCUMENTS

| | | | |
|---|---|---|---|
| EP | 2124206 | A1 | 11/2009 |
| EP | 2128834 | A1 | 12/2009 |
| WO | 2008041214 | A1 | 4/2008 |

* cited by examiner

*Primary Examiner* — Tai T Nguyen
(74) *Attorney, Agent, or Firm* — Burns & Levinson LLP; Orlando Lopez

(57) ABSTRACT

In one embodiment, the method of these teachings includes the steps of utilizing a remote server to manage security alerts, utilizing the remote server to administer security system updates and utilizing the remote server to configure the security system.

24 Claims, 6 Drawing Sheets

Prior Art

METHODS AND SYSTEMS FOR REMOTE MANAGEMENT OF SECURITY SYSTEMS

CROSS REFERENCE TO RELATED APPLICATIONS

This application claims priority of U.S. Provisional Application Ser. No. 61/307,207, entitled METHODS AND SYSTEMS FOR REMOTE MANAGEMENT OF SECURITY SYSTEMS, filed on Feb. 23, 2010, which is incorporated by reference herein in its entirety for all purposes.

BACKGROUND

These teachings relate generally to the field of commercial and residential security systems and, more particularly to the users ability to remotely access and control, via the Internet, the smart home and security peripheral devices managed by a remote system.

One of the major problems associated with current security systems is that all of the functionality associated with the system is centralized in the premises being secured by the system. By having the core operational component and corresponding system functionality centrally located in the monitored premises, it renders the system very susceptible to sabotage thereby making the system potentially disabled once an initial breach occurs. The system might be able to detect a breach into the premises, but once an individual has entered the monitored premises, the breaching individual has access to the entire security system due to its centralized location in the premises being monitored. As such, it is a significant concern, for security purposes, that the operational nature and corresponding functionally protecting a certain location is housed and maintained at the location being monitored.

Other than the limited telephonic communications between the Alarm Manager and a central monitoring station, the conventional art has very limited remote, off-site access. The lack of this remote access requires a technician to travel to the customer's premises to maintain, update and repair the system. These visits can be costly and time consuming, but more importantly, the system can be inoperative while waiting for the technician to address the problem leading to increased vulnerability. This is a significant problem in the current art as many system providers are chained to the telephonic communication system and, as such, are greatly limited in terms of remote access and maintenance.

Furthermore, the existing art requires a trained technician to install and integrate the various smart home and security peripheral devices with the system. Similar to the lack of remote functionality, this process can be very time consuming and cost prohibitive. Additionally, the requirements of a specialized electrical knowledge to access and diagnose the system inhibit its ability to be user friendly and easily maintained without specialized, professional knowledge.

There is therefore a need to provide a security system that allows for remote access, where such remote access shall allow accessibility and interaction with peripheral devices, communication between various peripheral devices, as well as diagnosing and administering the system.

There is a further need to utilize an off-site system where such off-site system contains all of the necessary functionally to allow the system to operate remotely with the various peripheral and access devices.

BRIEF SUMMARY

The problems set forth above as well as further and other problems are solved by the present teachings. These solutions and other advantages are achieved by the various embodiments of the teachings described herein below.

In one embodiment, the method of these teachings for rendering a security system less susceptible to sabotage it includes the steps of utilizing a remote server to manage security alerts and utilizing another remote system to arm and disarm the security system; the other remote system being in communication with the remote server. In another embodiment, the method of these teachings includes the steps of utilizing a remote server to manage security alerts, utilizing the remote server to administer security system updates and utilizing the remote server to set up the security system. In one instance, the step of managing security alerts includes determining a type of alert for an alert, merging an identifying ID with the alert type, determining a location of the alert and transmitting, using a transmitter and a preselected transmission method, the merged ID and alert type and the location to a predetermined site. In another instance, the step of setting up the security system includes referencing each security device in the security system to a device database; data in the device database comprising customer location, customer system preferences, customer name, and number and type of security devices utilized by the security system and enabling viewing/controlling a security device by means of a remote alarm keypad (also referred to as remote alarm console).

In one embodiment, the system of these teachings includes one or more processors, one or more communication devices for communicating over a network with remotely located security/Smart home devices and with a remote alarm console, one or more computer usable media having computer readable code embodied therein causing the one or more processors to: manage security alerts, administer security system updates and set up the security system.

For a better understanding of the present teachings, together with other and further objects thereof, reference is made to the accompanying drawings and detailed description and its scope will be pointed out in the appended claims.

DETAILED DESCRIPTION

Figure 1:
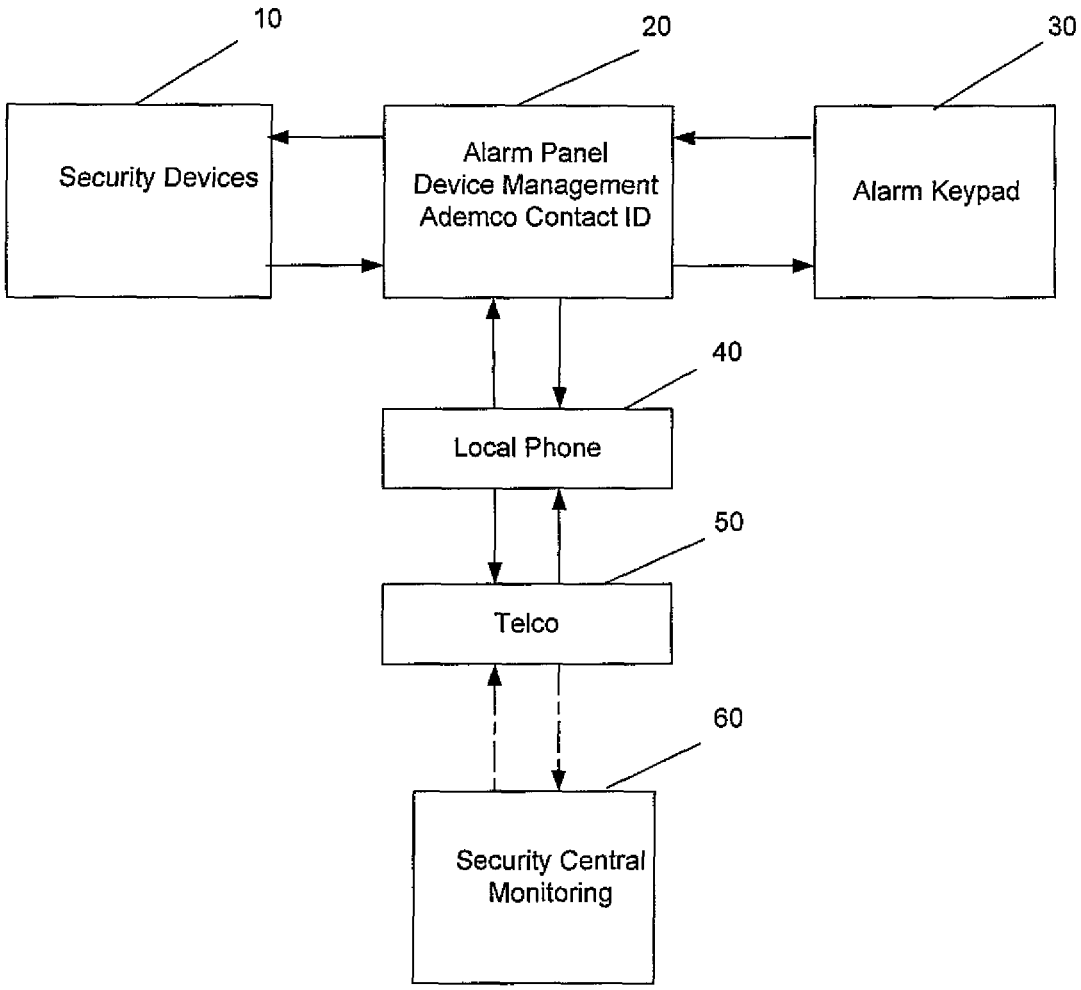
FIG. 1 is a flow chart demonstrating how the components and peripheral devices of a conventional system interact with each other and the central monitoring station.

Typically, a conventional system contains six components: 1) the Security Devices 10; 2) the Alarm Panel 20, which contains the management algorithms for the Security Devices; 3) the Alarm Keypad 30; 4) a Local Phone line 40; 5) a telephone communications company ("Telco") 60; and 6) a Security Central Monitoring station 70. In a conventional system, the Security Devices (e.g. motions sensors, window/door sensors) and the Alarm Keypad communicate with the Alarm Panel via a direct, hard-line connection. Additionally, the Alarm Panel sends various commands to the Security Devices as such commands were received from the Alarm Keypad. In the event of an alert, the Security Device sends a communication to the Alarm Keypad via the Alarm Panel. If a certain communication via the Alarm Keypad is not received in a particular time, the Alarm Panel will transmit the alert via the Local Phone and Telco to a Security Central Monitoring station. The Security Central Monitoring would then interpret the signal and communicate via the same telephone to the Alarm Panel or the customer. In a conventional system, the Security Devices, Alarm Panel and Alarm Keypad are hardwired into the monitored premises thereby creating limited remote accessibility and vulnerability. Additionally, in order for a user to access or determine the systems status, the user must be physically present in the premises.

"Remote," as used herein, refers to being located at a different physical location, or having the capability to be moved to a different physical location from, and not being physically connected to the security devices or having the ability to access the system from a different physical location of the system.

"Physically connected," as used herein, does not include being connected by means of a wireless connection or being connected to a wireless network.

"Monitoring site/center," as used herein, refers to a remote manned or unmanned station that receives various alerts or other signals sent from the security system where, after receiving and interpreting such signal, an automated or manual response is undertaken based on the signal and its interpretation. In one instance, the received signal includes a protocol that indicates the nature of the signal and an indicator of the location from which to signal originates.

"Security devices," as used herein, includes devices such as, but not limited to, motions sensors, window/door sensors, surveillance cameras, proximity alarms, identification verification systems (e.g. keycard readers, retina scanners, etc.), pressure sensors, temperature sensors, light sensors and smell detectors (e.g. smoke detectors). A "security system," as used herein, is a system including one or more security devices, the system being designed, installed and operated to monitor, detect, observe or communicate about activity that may pose a situation of interest (such as, but not limited to, a security threat) in a location or locations.

"Emergency authorities," as used herein, includes, but shall not be limited to any governmental authority providing police, fire or medical assistance or a private agency empowered by the customer or by operation of law to provide emergency police, fire and medical services.

Figure 2:
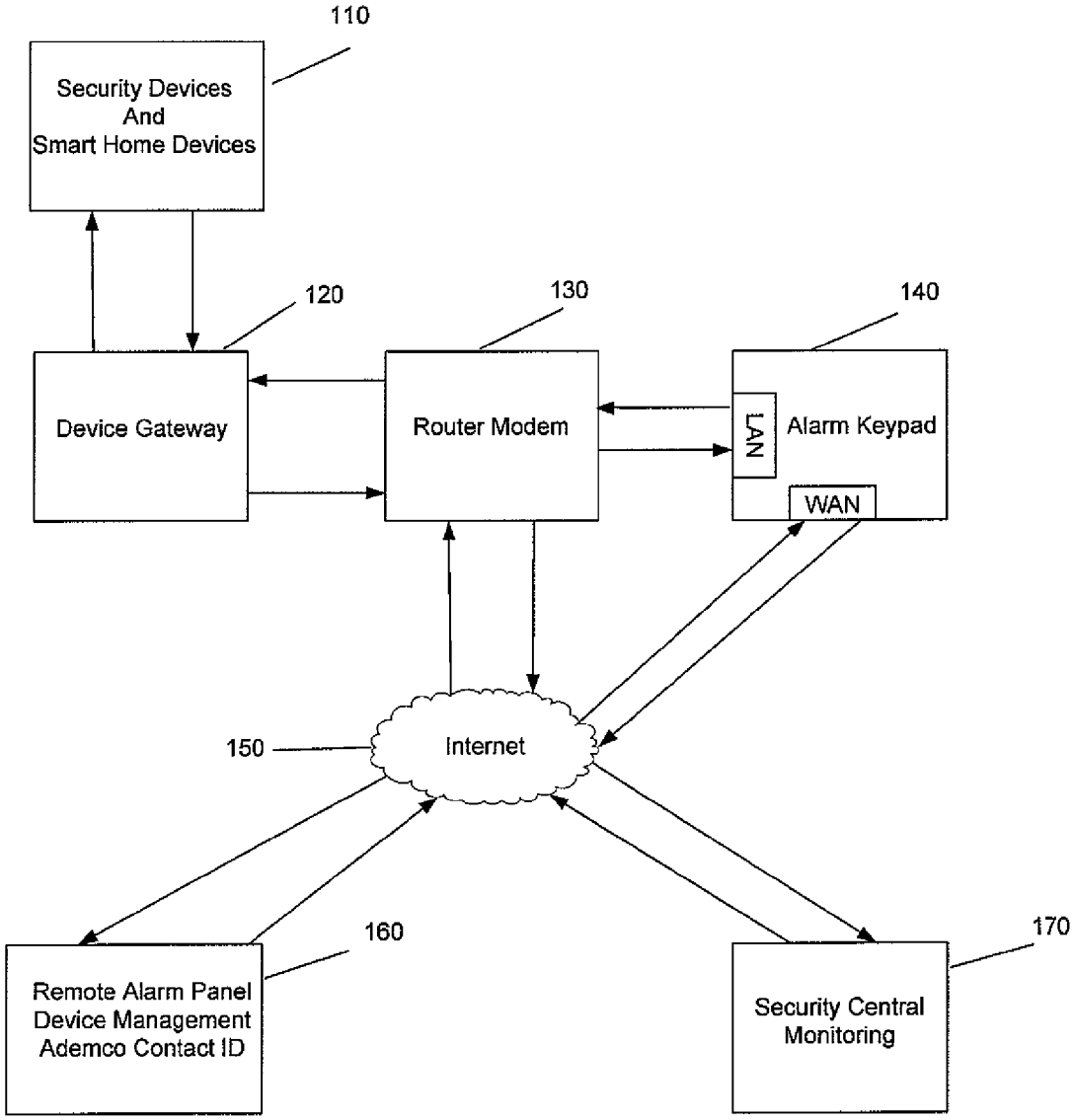
FIG. 2 is a chart that shows the key components and their relationship with other components in the present teachings.

The present teachings, however, incorporate different pathways to provide increased functionality and to solve the problems set forth above. As shown in FIG. 2, an embodiment of the present teachings comprises seven overall components: 1) Security Devices (similar to those in a conventional system) 110, 2) a Device Gateway 120, 3) a Router Modem 130, 4) a remote Alarm Keypad (also referred to as an Alarm Console) 140; in some embodiments of the present teachings, the remote Alarm Console 140, although referred to as "Keypad," to be implemented electronically or using touch displays), 5) a network such as, but not limited to, the Internet 150, 6) Remote Alarm Panel 160 and 7) Security Central Monitoring than 70. The Device Gateway 120 acts as a central conduit in which all of the various Security Devices channel information to the Router Modem 130, which in turn, submits the data through the Internet 150 so it can reach the Remote Alarm Panel 140, which will then interpret and send the information via the Internet 150 to the Security Central Monitoring 170 and the Alarm Keypad 140. It should be noted that both the Alarm Keypad 140 and the Device Gateway 120 are remote from the Security Devices 110.

The remote Alarm Keypad (Alarm Console) is a mobile, computerized device (having one or more processors) that has the ability to access a network, such as the Internet, and communicate with the Remote Alarm Panel using a remote communication method, such as, but not limited to, wireless communications. This functionality is accomplished by placing specialized software (a computer usable medium has the specialized software embodied therein, the specialized software causing the one or more processors to perform the method described herein) on the device that has the ability to access and communicate with the Remote Alarm Panel utilizing various computerized call structures. The remote Alarm Keypad 140 (Alarm Console) serves a substantively similar function to the Alarm Keypad 20 in a conventional system, but due to use of networks, such as, but not limited to, the Internet and software, the Alarm Keypad does not need to be physically connected to the Alarm Panel or any of the Security Devices. In one embodiment, the Alarm Keypad, however, does not directly communicate with any of the Security Devices or the Device Gateway as all communications from the Alarm Keypad 140 are channeled through the Remote Alarm Panel 160.

The Remote Alarm Panel acts as the centralized intelligence of the system as it facilitates communication, via the Internet, between the Alarm Keypad (Alarm Console), the Security Central Monitoring and the Security Devices. The Remote Alarm Panel is, in one embodiment, a server that contains each customer's information, system configuration and alerts. This device will be housed at a remote location (e.g., but not limited to, the provider's location) and it is not necessary for it to be placed in the monitored premises. The Remote Alarm Panel, however, is not restricted to a hardware device as its major functionality is accomplished through software algorithms.

As compared to conventional systems, the present teachings allow complete remote functionality via a network, such as the Internet. There is no longer a need to physically connect or centrally locate any of the peripheral devices. This allows for the user to access the system from anywhere where Internet (network) connectivity is available. Additionally, an administrator function can remotely provide software updates as well as diagnose and maintain many major components of the system.

Figure 3:
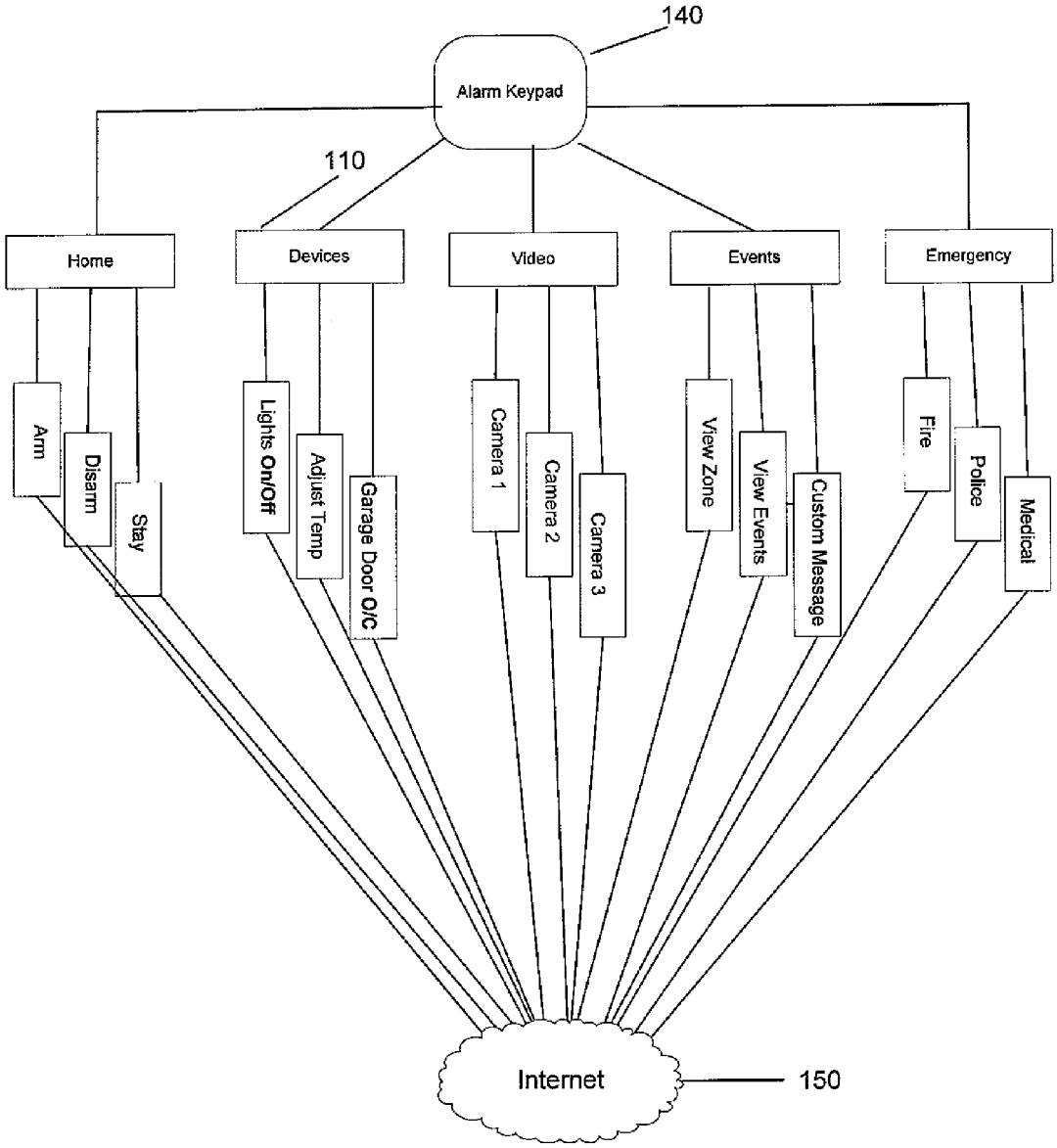
FIG. 3 is a chart that shows the device interaction between the Alarm Keypad and the Remote Alarm Panel in the present teachings.
Figure 4:
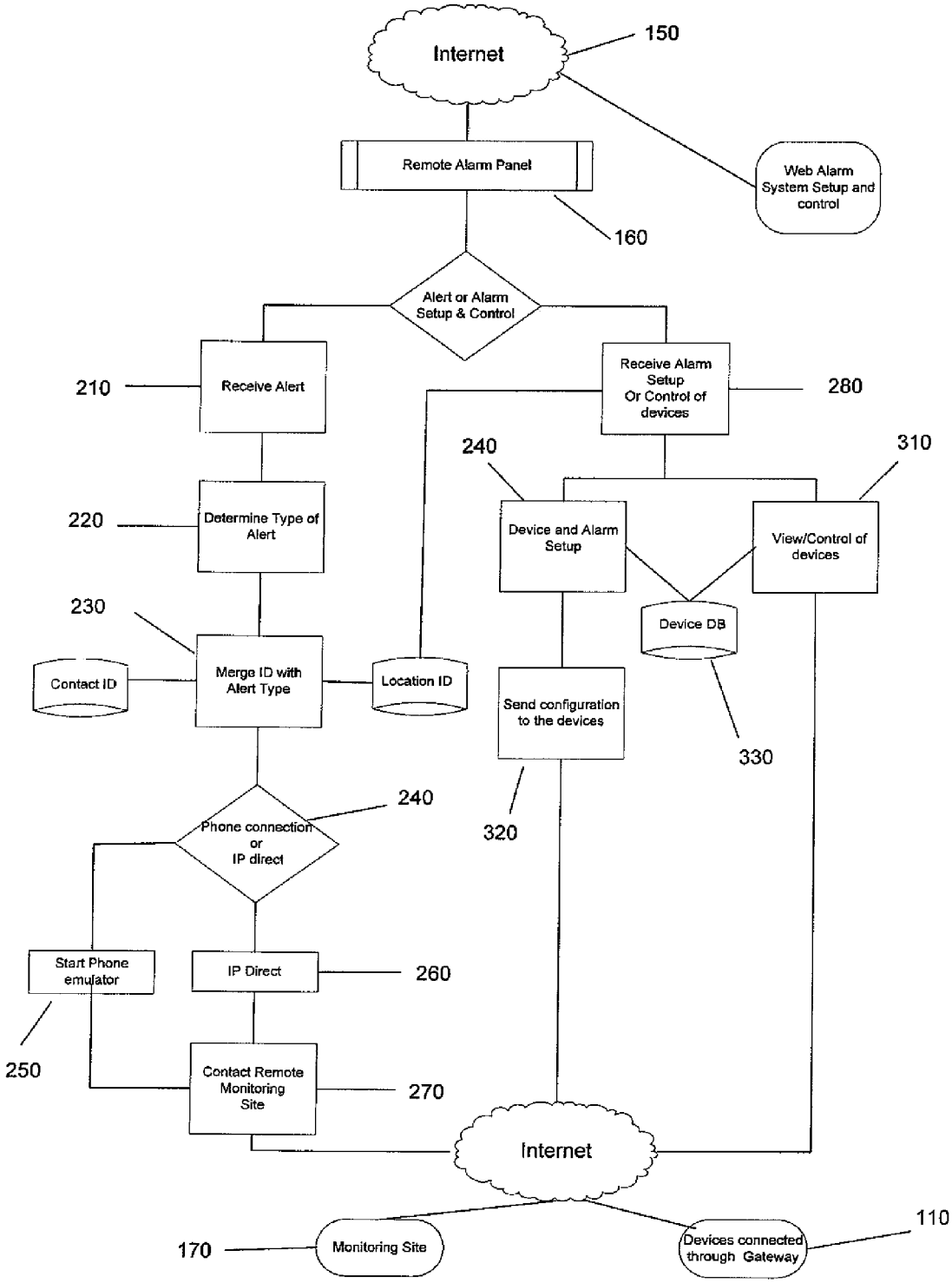
FIG. 4 represents a chart of the components contained in the Remote Alarm Panel as set forth in the present teachings.
Figure 5A:
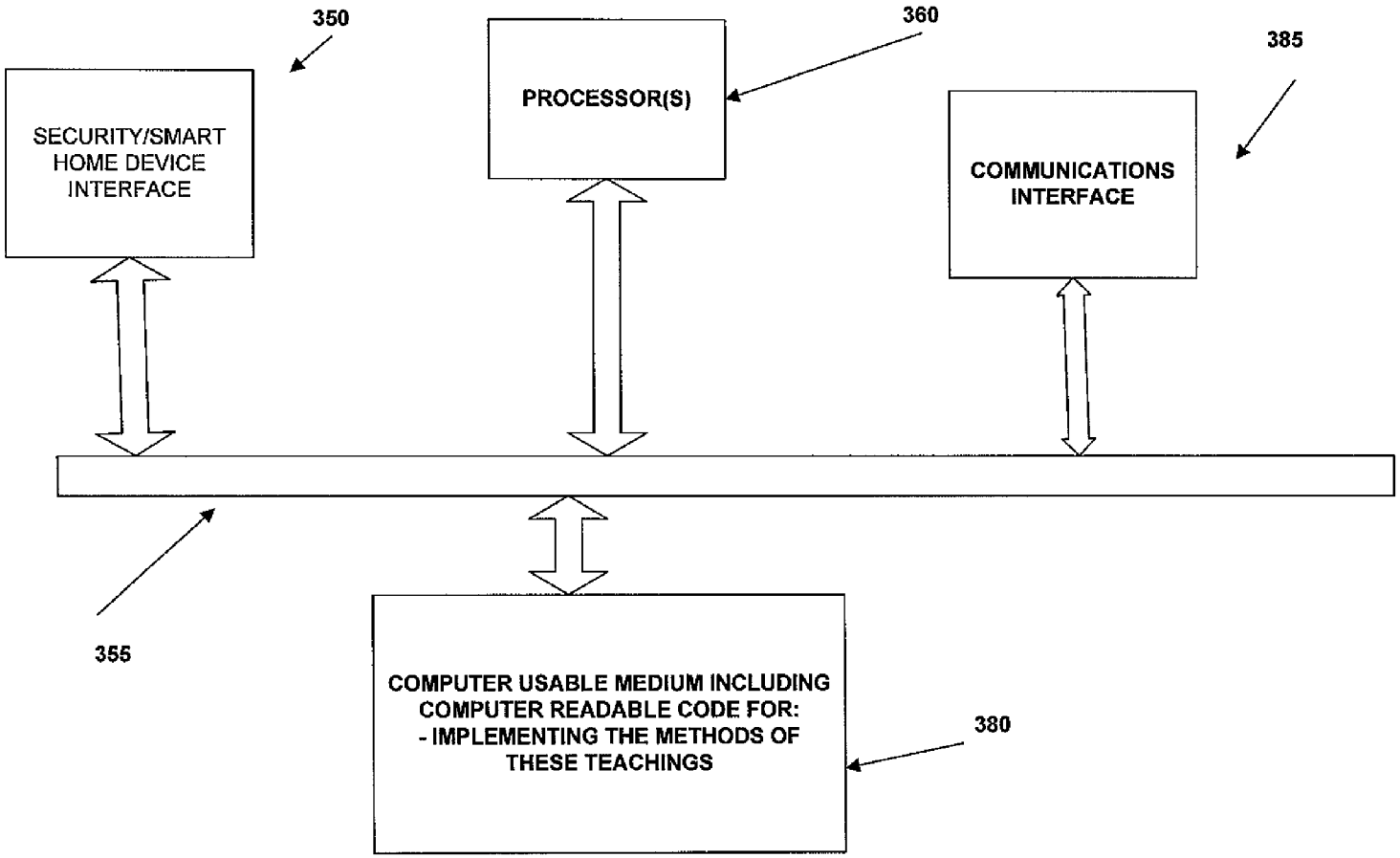
FIG. 5*a* is a block diagram representation of a portion of the Remote Alarm Keypad of these teachings.

FIG. 3 shows in greater detail the interaction, in one embodiment, between the Alarm Keypad (Alarm Console) 140 and the Remote Alarm Panel 160 (160, FIG. 4). Utilizing the software on the Alarm Keypad 140 and the Remote Alarm Panel 160, the Alarm Keypad 140 can access the various components of the system such as 1) arming and disarming the system; 2) accessing the functionality of specific devices; 3) receive video feeds from any cameras; 4) log all events; and 5) contact emergency authorities. The conventional systems have limited Alarm Keypad functionality as a conventional system usually allows the user to arm or disarm and contact emergency authorities. The enhanced functionality of the Remote Alarm Keypad 140 is manifested by remote operation utilizing a network such as the Internet 150 being further enhanced by the characteristic that the Remote Alarm Keypad 140 has its own software (embodied in a computer usable medium, 380, FIG. 5*a*) and processing capabilities (processors, 360, FIG. 5*a*). All of the functionality is running on the Remote Alarm Panel. The Alarm Keypad runs an application that allows the Alarm Keypad to interact with the Remote Alarm Panel where such interaction is analogous to a PC application running on a fixed computer (such as, but not limited to, distributed processing). When the Alarm Keypad sends a request to contact emergency authorities, the request is processed through the Remote Alarm Panel, which, in one embodiment, has the database and correct logic algorithms to select the user designated reaction to the request. The Remote Alarm Panel can be configured to directly call the emergency authorities or send the event alert to a central monitoring center. Because the core functionality, algorithms and logic are contained in the Remote Alarm Panel database or similar storage configuration, the configuration of the system can be changed over the network. The Alarm Keypad has a custom user interface (350, FIG. 5*a*) that a user can utilize to gain control over security and smart home functionality. This functionality is accomplished through the Alarm Keypad which utilizes web commands that directly communicate with the Remote Alarm Panel wherever internet connectivity is available (see communications interface 385, FIG. 5*a*). One embodiment of a portion of the remote alarm keypad is shown FIG. 5*a*. The components described hereinabove are operatively connected by a connection component 355 (such as a computer bus).

Interaction with the security system is obtained by means of the Remote Alarm panel 160, in some instances in conjunction with the Remote Alarm Keypad 140. The interaction with the security system includes, but it is not limited to, arming and disarming the security system or arming and disarming particular security devices in the security system, adjusting settings or parameters of predetermined security devices, updating firmware of predetermined security devices, adding new features to predetermined (selected) security devices, expanding capability of predetermined security devices, controlling predetermined security devices, and making requests of and obtaining device output from predetermined security devices. These capabilities are shown in FIG. 4. Software (computer readable code) at the Remote Alarm Panel 160 enables the above capabilities FIG. 4 outlines the various components and the corresponding pathways incorporated into the logic of the Remote Alarm Panel 160. The Remote Alarm Panel 160 enables a principal remote functionally of the system as it provides the necessary software to remotely manage alerts, administer remote updates (including security device or system firmware, adding new features, expanding capability), administer remote adjustment of settings or parameters, remotely control the security devices, send requests for device output or receive device output and initially setup the system. The Remote Alarm Panel 160 receives signals from the security devices and from the Remote alarm Keypad 140 through the network 150, as shown in FIG. 3. When a signal is received by the system from a Security Device, Alarm Keypad or authorized maintenance operator the signal can follow one of two paths: 1) the signal represents an alert; or 2) the signal represents a maintenance or setup request.

If the signal represents an alarm alert (210, FIG. 4), there are three major steps: 1) determine the Alert Type (220, FIG. 4); 2) merge ID with Alert Type (230, FIG. 4); and 3) transmit the alert via an appropriate avenue to a Monitoring Site, a customer, designated emergency authorities, a combination of the above, or all of them at once. (240, 260, 250, 270, FIG. 4). When an alert is received, industry standard communication protocols, such as, but not limited to, Ademco® Contact ID, are applied to determine the nature of the alarm. Once the alarm's nature is determined, it is then necessary to merge the industry standard protocol with a Location ID database to determine which system, and consequently, which customer is receiving the alert. Once the type of alert and the location of the alert are determined, it is then necessary to alert the Monitoring Site 170 (or a customer, designated emergency authorities, etc. or all of them at once.) via the Internet 150. Most Monitoring Sites utilize telephone lines to receive alerts and, as such, it might be necessary to utilize a Smart Phone Emulator so the telephone signals can be passed via the Internet and be properly received by the Monitoring Site or other receiving site. If, however, the Monitoring Site (or other receiving site) can receive and interpret IP signals, the alert can also be transmitted directly to the Monitoring Site via the Internet. If the signal is a configuration (also referred to as "setup") request (280, FIG. 4), there are three major components to this process: 1) Device and Alarm Setup (290, FIG. 4); 2) View/Control of Devices (310); 3) the Device DB (Database) 330. When a system is being configured (setup) or modified the various Security Devices need to be registered on the system in order to allow a user to access the devices via the Alarm Keypad (Alarm Console) and for the Remote Alarm Panel to properly monitor the devices. As such, a new Security Device is registered on a particular user system by referencing it in the Device DB. The Device DB contains all of the information to a particular customer, including, but not limited to customer location, customer's system preferences, customer name, and number and type of Security Devices utilized by customer. The Device DB acts as a centralized location that can be accessed during setup or when a customer wishes to View or/and Control a Security Device via the Alarm Keypad (Alarm Console). Once the necessary actions have been completed in the logic, the resulting information to facilitate the request is transmitted via the Internet to the Security Device or Alarm Keypad (Alarm Console).

Figure 5B:
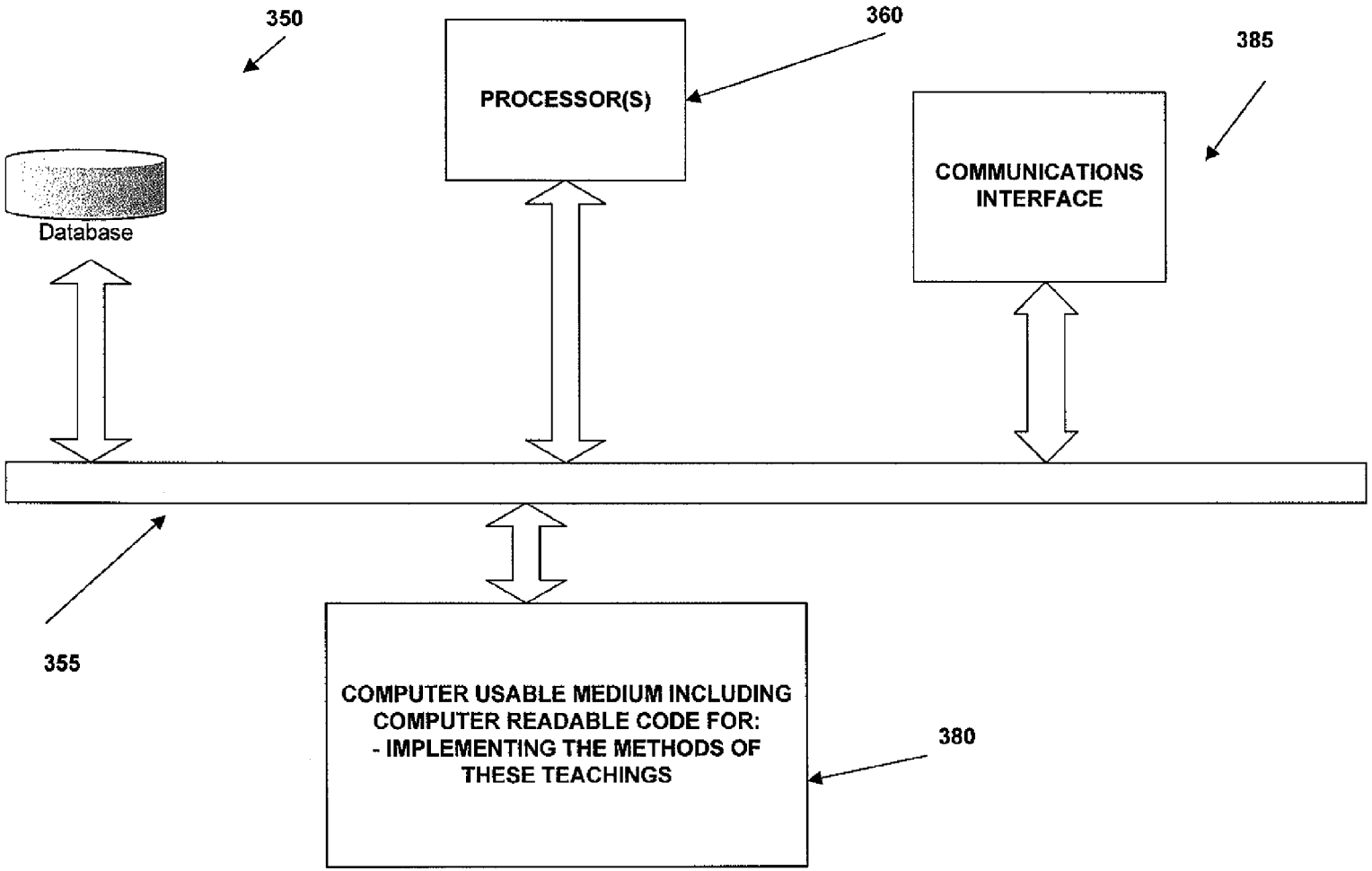
FIG. 5*b* is a block diagram representation of a portion of the Remote Alarm Panel of these teachings.

In one embodiment, the Remote Alarm Panel of these teachings includes one or more processors (460, FIG. 5*b*), one or more communication devices for communicating over a network with remotely located security/Smart home devices and with an alarm console (485, FIG. 5*b*), one or more computer usable media having computer readable code embodied therein causing the one or more processors to: manage security alerts, administer security system updates and set up or update or monitor the security system (480, FIG. 5*b*). In one instance, the Remote Alarm Panel also includes another computer usable medium having the database 450 described hereinabove embodied therein. One embodiment of the general structure of the Remote Alarm Panel 160 is shown in FIG. 5*b*.

Since the core functionality is remote, all of the controls and functionally are accessible from the network and, as such, there is no need to have access to the monitored premises. A vast majority (approx. 99%) of the updates or repairs can be fixed remotely via software updates. This will allow the system provider to transparently enhance the features and functionally provided to the user without disrupting mission critical components of the overall system. Remote management tools will be used to monitor user gateways with the ability to proactively resolve hardware and software issues as they arise.

In one instance, a network, such as, but not limited to, the Internet, is utilized via a remote device with computing capability, Alarm Keypad 140 (in one instance these teachings not being limited only to that instance, an iPod Touch™) to manage, control, interact and receive communications from various security peripheral devices installed in another remote location. In, this embodiment, all security system functionality resides remotely from the computer and peripheral devices location. All security device management, alarm alerts, generation of the alarm Contact ID, communication to a remote monitoring center all reside at a remote site from the device with computing capability 140 and security peripheral device locations.

In one instance, all of the functionality enabled by a broadband connection is utilized to remotely manage security peripheral devices. All security devices are connected through a broadband gateway to a remote data site, Remote Alarm Panel 160, where all security functionality and configuration resides. System configuration and functionality can be accessed remotely via a remote computer. Any alarm from an armed device or emergency alert from the remote computer will generate the appropriate Contact ID codes (in one instance, industry standard transmission protocols) and transmit the information to a central monitoring station via a transceiver (in one exemplary embodiment, Sur-Gard™ receiver and Security monitoring software is utilized). In one instance, disruption of the network connection between a security device and the gateway generates an alert. Some features of the Remote Alarm Panel include:

Broadband software Alarm Manager

Alarm manager will emulate functionality commonly associated with an alarm panel hardwired into a monitored location;

Broadband Phone pulse/tone Generator,

Broadband software for communication protocols (in one exemplary embodiment, the Ademco® Contact ID communication protocol, although equivalent or other communication protocols and are within the scope of these teachings), Broadband interface to a transceiver (in an exemplary embodiment a Sur-Gard™ receiver, although equivalent or other transceivers are within the scope of these teachings).

The method and system of the present teachings enable controlling a security system and smart home devices using a computer application to emulate conventional alarm panel keypads using virtual controls over alarm system behavior. The computer application communicates through a secure wireless connection to the remote alarm panel site 160 and back through the gateway 120 providing substantially constant communication I/O with all system devices.

Some computer application features include:

a. Ability to arm and disarm security system b. Ability to contact emergency authorities such as police, fire, and hospital c. Ability to control smart home devices d. Ability to view live Internet Protocol video and initiate camera controls for Pan Tilt Zoom functionality.

e. Ability to view all alarms on the system including system activity.

In the embodiment described hereinabove, Applications can exist on the same network and receive simultaneous updates from a central location. Application can receive updates remotely to enable/disable features and add product enhancements without the need for customer interaction.

For the purposes of describing and defining the present teachings, it is noted that the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

Elements and components described herein may be further divided into additional components or joined together to form fewer components for performing the same functions.

Each computer program may be implemented in any programming language, such as assembly language, machine language, a high-level procedural programming language, or an object-oriented programming language. The programming language may be a compiled or interpreted programming language.

Each computer program may be implemented in a computer program product tangibly embodied in a computer-readable storage device for execution by a computer processor. Method steps of the invention may be performed by a computer processor executing a program tangibly embodied on a computer-readable medium to perform functions of the invention by operating on input and generating output.

Common forms of computer-readable media include, for example, a floppy disk, a flexible disk, hard disk, magnetic tape, or any other magnetic medium, a CDROM, any other optical medium, punched cards, paper tape, any other physical medium with patterns of holes, a RAM, a PROM, and EPROM, a FLASH-EPROM, any other memory chip or cartridge, or any other medium from which a computer can read. From a technological standpoint, a signal or carrier wave (such as used for Internet distribution of software) encoded with functional descriptive material is similar to a computer-readable medium encoded with functional descriptive material, in that they both create a functional interrelationship with a computer. In other words, a computer is able to execute the encoded functions, regardless of whether the format is a disk or a signal.

Although the invention has been described with respect to various embodiments, it should be realized that these teachings are also capable of a wide variety of further and other embodiments within the spirit and scope of the appended claims.

What is claimed is:

1. A method for rendering a security system less susceptible to sabotage, the method comprising:

utilizing a remote server to manage security alerts; the remote server having security system configuration information and alert information;

maintaining and diagnosing security system configuration using the remote server; and utilizing, by means of the remote server, a remote alarm console to interact with the security system; said remote alarm console being in communication with said remote server; said remote alarm console not being in direct communication with the security system;

whereby remote functionality obtained using the remote server renders the security system less susceptible to sabotage.

2. The method of claim 1 wherein the step of utilizing the remote server to manage security alerts comprises:

determining a type of alert for an alert;

merging an identifying ID with the alert type;

determining a location of the alert; and transmitting, using a transmitter and a preselected transmission method, the merged ID and alert type and the location to a predetermined site.

3. The method of claim 1 wherein the step of utilizing said remote alarm console to interact with the security system comprises:

utilizing, by means of the remote server, said remote alarm console to arm and disarm the security system; and accessing functionality of predetermined security devices.

4. The method of claim 3 wherein the step of utilizing the remote server to manage security alerts further comprises:

contacting, if an alarm is received, a predetermined site.

5. The method of claim 4 wherein the predetermined site is at least one of a monitoring site, a customer or one or more designated emergency authorities.

6. The method of claim 3 wherein the step of utilizing said remote alarm console to interact with the security system further comprises:

receiving output from predetermined security devices.

7. The method of claim 3 wherein the step of utilizing said remote alarm console to interact with the security system further comprises:

generating a log of events captured by the predetermined security devices.

8. The method of claim 3 wherein the step of accessing functionality of predetermined security devices comprises:

adjusting settings/parameters of predetermined security devices.

9. The method of claim 3 wherein the step of accessing functionality of predetermined security devices comprises:

updating firmware of predetermined security devices.

10. The method of claim 3 wherein the step of accessing functionality of predetermined security devices comprises:

adding new features/capabilities to predetermined security devices.

11. The method of claim 3 wherein the step of accessing functionality of predetermined security devices comprises:

controlling predetermined security devices.

12. The method of claim 3 wherein the step of accessing functionality of predetermined security devices comprises:

requesting output of predetermined security devices.

13. A method for rendering a security system less susceptible to sabotage, the method comprising:

utilizing a remote alarm console, said remote alarm console being in communication with a remote server, to:

arm and disarm the security system;

access functionality of predetermined security devices; and receive output from predetermined security devices;

said remote alarm console not being in direct communication with the security system;

the security system being maintained and diagnosed by means of the remote server;

whereby remote functionality obtained by using the remote server renders the security system less susceptible to sabotage.

14. The method of claim 13 wherein the remote alarm console is further utilized to:

generate a log of events captured by the security devices.

15. A monitoring system comprising:

at least one remote alarm console; said at least one remote alarm console comprising:

at least one first processor;

at least one first non transitory computer usable medium having computer readable code embodied therein, said computer readable code causing said at least one first processor to:

arm and disarm a security system; said security system comprising at least one security device;

access functionality of predetermined security devices from said at least one security device; and receive output from predetermined security devices from said at least one security device;

at least one database; said database having information for said security system, said information comprising location, system preferences, identifying information, type of security device and identifier for said at least one security device and number of security devices in said security system;

a remote server comprising:

at least one second processor; and at least one second non-transitory computer usable medium having computer readable code embodied therein, said computer readable code causing said at least one second processor to:

determine a type of alert for an alert;

merge an identifying ID with the alert type;

determine a location of the alert;

transmit, using a transmitter and a preselected transmission method, the merged ID and alert type and the location to a predetermined site;

utilize said remote alarm console to arm and disarm the security system; and access, by means of said remote alarm console, functionality of predetermined security devices from said at least one security device;

said remote alarm console, said security system and said remote server operatively connected by one or more networks.

16. The monitoring system of claim 15 wherein said computer readable code in said second non-transitory computer usable medium causes said at least one second processor to:

contact, if an alarm is received, a predetermined site.

17. The monitoring system of claim 16 wherein the predetermined site is at least one of a monitoring site, a customer or one or more designated emergency authorities.

18. The monitoring system of claim 15 wherein said computer readable code in said second non-transitory computer usable medium causes said at least one second processor to:

receive output from predetermined security devices from said at least one security device.

19. The monitoring system of claim 15 wherein said computer readable code in said second non-transitory computer usable medium causes said at least one second processor to:

generate, by means of said remote alarm console, a log of events captured by each security device from said at least one security device.

20. The monitoring system of claim 15 wherein said computer readable code in said second non-transitory computer usable medium causes said at least one second processor to:

access said at least one database;

retrieve from said at least one database, the information for the security system; and provide, via said at least one network, information for configuring/maintaining/updating the security system to said remote alarm console or to a security device from said at least one security device.

21. The monitoring system of claim 20 wherein said computer readable code in said second non-transitory computer usable medium causes said at least one second processor to:

if the security system is being configured, register each one of said at least one security device, registration including entering into said at least one database said information for each security device in the security system.

22. The monitoring system of claim 20 wherein said computer readable code in said second non-transitory computer usable medium causes said at least one second processor to:

if the security system is being updated, update, in said at least one database, said information for each security device from said at least one security device.

23. The monitoring system of claim 20 wherein said computer readable code in said second non-transitory computer usable medium causes said at least one second processor to:

monitor said at least one security device.

24. The monitoring system of claim 15 wherein the predetermined site is at least one of a monitoring site, a customer or one or more designated emergency authorities.

* * * * *